United States Patent [19]

Cournoyer et al.

[11] Patent Number: 5,031,425

[45] Date of Patent: Jul. 16, 1991

[54] DOUBLE KNIT FABRIC WITH HOLES THERETHROUGH AND KNITTED COLOR BANDS

[75] Inventors: Andre Cournoyer, Ste Rosalie; Serge Berard; Denis Cote, both of St-Hyacinthe, all of Canada

[73] Assignee: Sport Maska Inc., St. Hyacinthe, Canada

[21] Appl. No.: 339,983

[22] Filed: Apr. 18, 1989

Related U.S. Application Data

[62] Division of Ser. No. 937,077, Dec. 2, 1986, Pat. No. 4,838,045.

[30] Foreign Application Priority Data

Nov. 27, 1986 [CA] Canada ..... 523976

[51] Int. Cl.[5] ..... D04B 9/06

[52] U.S. Cl. ..... 66/196; 66/198

[58] Field of Search ..... 66/196, 197, 198, 200

[56] References Cited

U.S. PATENT DOCUMENTS

| | | | |
|---|---|---|---|
| 2,323,855 | 7/1943 | Smith, Jr. | 66/198 X |
| 3,034,324 | 5/1962 | McDonough | 66/198 X |

FOREIGN PATENT DOCUMENTS

| | | | |
|---|---|---|---|
| 59-137547 | 8/1984 | Japan | 66/196 |
| 446784 | 5/1936 | United Kingdom | 66/200 |
| 2172019 | 9/1986 | United Kingdom | 66/198 |

*Primary Examiner*—Wm. Carter Reynolds

*Attorney, Agent, or Firm*—Fleit, Jacobson, Cohn, Price, Holman & Stern

[57] ABSTRACT

This double knit fabric for sports garment, namely sweater and hockey includes a repeated pattern of predetermined courses containing wales of consecutive selected groups of tuck and welt stitches to form holes in and throughout the knitted fabric. The pattern is repeated to provide a fabric with a considerable number of holes aligned in a predetermined geometrical arrangement. The holes are formed in one to two adjacent wales on the cylinder by the combination of many tuck stitches in consecutive courses with welt and knit stitches associated thereto in the courses preceding and following same tuck stitches. The fabric can be of uniform color but may also be knitted to provide horizontal color bands of various widths and colors depending on the yarn color and the number of consecutive courses with a different color of yarn and the desired color arrangements.

3 Claims, 8 Drawing Sheets

KNIT ×
WELL o
TUCK •

DOUBLE KNIT FABRIC WITH HOLES THERETHROUGH AND KNITTED COLOR BANDS

This is a division of application Ser. No. 06/937/077, filed Dec. 2, 1986, now U.S. Pat. No. 4,838,045.

This invention refers to a double knit fabric to make uniforms, primarily sweaters and stockings, for players engaged in very active sports.

This invention is particularly concerned with a type of double knit fabric of heavy construction embodying a considerable number of holes therethrough to allow control of the body heat with respect to perspiration of the player wearing same, when one is engaged in an active sport giving rise to many contacts with players or with equipment such as in hockey, football, socker, softball, baseball, basketball, volleyball, rugby, broomball and ringuette.

Since all of these sports are team sports where there is a custom that the players of each team wear a distinctive uniform which is most of the time made of a specific color arrangement and more particularly of a sequence of bands of various colors and widths, our invention relates to the construction of a knitted fabric for such sports.

Until now, knitted garments for these sports were made of either a double knit fabric made on a circular knitting machine, with two sets of needles, one vertical on a cylinder and one horizontal on a dial, at right angle one in relation to the other, as opposed to the single knit machine having only one set of needles or on a warp knit machine, each providing a different construction of fabric.

It is presently known that a fabric emanating from a warp knit machine specifically set up for this purpose, may have many holes therein. Yet this machine does not have the desired flexibility to provide the change of color, the different dimensions or widths of color bands that are desired or in demand in the said sports.

With the fabric emanating from a warp knitting machine, the color arrangements desired for a uniform will be achieved by the sewing in color bands or color panel arrangements. At the present time to make such a sweater, a piece of fabric of a given color representing the basic predominant color of the uniform is cut and stripes of fabric representing the desired color arrangements are sewn-in at the desired location to constitute the body and sleeves of the garment, sweater and stockings. The fabric for the sewn-in stripes or bands of a different color may or may not be of the same warp knit construction, configuration or material. An alternative is also used and is present in the products presently marketed, wherein panels are sewn-in. The said panels are generally of a different double knit construction with the various colors of various widths, but this double knit panel would not have the desired holes therein. Instead of warp knit fabric, manufacturers have used a mesh knit fabric as the material for the sewn-in method.

Both of the garments with the sewn-in bands or panels have disadvantages. The cutting and the seams require additional operations and time in the manufacturing process and add to the cost of the product. Notwithstanding the higher cost, the seam constitutes elements of weakness, discomfort and eventual unpleasant appearance of the garment. In a body contact sport the garment is submitted to tension, stretching, pulling or contact with a sporting equipment or apparatus such as a hockey stick, a skate blade as it occurs normally and frequently in hockey, rugby, football, and even occasionally in other sports with the possible hug of a player falling down and grabbing the garment of another player.

A further disadvantage of such a fabric resides in the sewn-in panel of color bands. Prior to the present invention, it was not known how to make color bands within the same product without additional operations, unless it was made of a different knit construction such as a plain double knit but without holes. The double knit fabric used to make the panel does not have the same vertical and horizontal elasticity as the warp knit of the main part of the garment, nor the same density, and does not provide for the same comfort. Furthermore, the appearance of the garment changes after it has been worn a few times.

Some have attempted to overcome these disadvantages with another solution in association with the warp knit fabric. Color bands were printed by silk screen on the main fabric to achieve the desired color arrangement. This again has the increased cost of the additional operation. Furthermore, the texture and greater density of the area of the fabric that has been submitted to this printed process is modified by the substance added to the fabric in the printing operation and the yarns being rigidly fixed in the band, the fabric does not have the same elasticity, lengthwise or sidewise, as the main part of the garment, so the garment is not as comfortable. Furthermore, with prolonged wear over at least one season of use of this garment for a given sport, the color arrangement is likely to deteriorate and the appearance of the garment changes correspondingly. Attempts were made to overcome this disadvantage in dyeing the color bands in the fabric. The resulting fabric with color arrangement constitutes an improvement over the printed silk screen process and resulting product, but the process again requires an additional operation and is also substantially more expensive, almost uncompetitive.

It is presently known and there are presently on the market knitted garments with different color arrangements but these are made of plain knitted material without any holes. Certain knitted constructions are also available with the pin or candy stripes, knitted in the fabric and made with double knit and double layer construction, but again none are made with holes therethrough. Furthermore, they do not have the flexibility to provide color arrangements of various colors, various widths and pattern repeats.

It is an object of the present invention to have a fabric made of a double knit structure with an arrangement of holes therethrough to provide comfort to the wearer engaged in active sport or event. A further invention is to have in the said fabric with holes and knitted-in color bands of variable widths and/or different colors, said variation and color differences readily suitable for a great number of color arrangements of uniforms and of variable dimensions, taking into account, the pro rata dimension of the color bands in a sweater and in matching stockings, the different sizes for players or wearers of different height or weight.

It is an object of the present invention to avoid the additional costs, operations and drawbacks of the sewn-in stripes, the sewn-in panels, bands, the printed silk screen fabric and the died fabric or of the plain knitted fabric with color arrangements knitted-in but without holes.

It is an object of the present invention to have sport garments made with said fabric as a uniform, with predetermined color arrangement, size and with matching parts such as sweaters and stockings.

As a result of intensive and prolonged research, the inventors have succeeded in obtaining a new double knit fabric overcoming the above mentioned disadvantages. A unitary double knit fabric has a considerable number of holes therein, each of which as a result of a new arrangement of knit, tuck and welt stitches.

Furthermore, in the same unitary fabric, there are or could be introduced bands of various colors and widths corresponding to the color of the yarn used to knit and the number of consecutive courses thereof.

In our invention, we have a double knit fabric, made of synthetic or natural yarn or a combination of both, with many holes through the double knit fabric in a repeated pattern fashion. The said hole comprises a combination in at least one cylinder wale of consecutive courses of yarns comprising at least two tuck stitches adjacent one to the other, while the dial wales yarns are generally and substantially knitted.

In variations of our invention, the number of stitches comprises a combination of two to eight consecutive tuck stitches, wherein the man skilled in the art will use a finer yarn in a grouping of at least four or five yarns and then a coarser gage for the grouping of six to eight yarns.

Further variations are made in having a welt stitch in course preceding the group of tuck stitches, and also in having at least a welt in the second course following the said group of tuck stitches.

While in the referred embodiment of our invention the hole arrangements are in a diagonal alignment with the holes in a first, second, and third horizontal group of six courses, one group phased to one side by two wales in relation to the preceding one for a global repeat pattern at each eighteen courses, the holes may be aligned in horizontal and vertical to form a plain grid of square, rectangular or diamond area between the holes, or many other geometrical arrangements of hole locations.

In our invention, the double knit fabric may be of a unique color resulting from the predetermined choice of yarn to knit the fabric. Furthermore, we may have knitted-in horizontal bands of different colors and any dimensions in having a consecutive number of courses knitted with a yarn of a different and predetermined color. Consequently, with our invention, we have a double-knit fabric with holes and knitted-in color bands of different widths to make sports uniforms of any desired color arrangement for sweaters and matching stockings, with the flexibility of pro rata modifications to allow variations for uniforms of different sizes.

An embodiment of the present invention will hereinafter be explained by referring to the accompanying drawings illustrating the preferred embodiment as well as some variations thereof.

Figure 1:
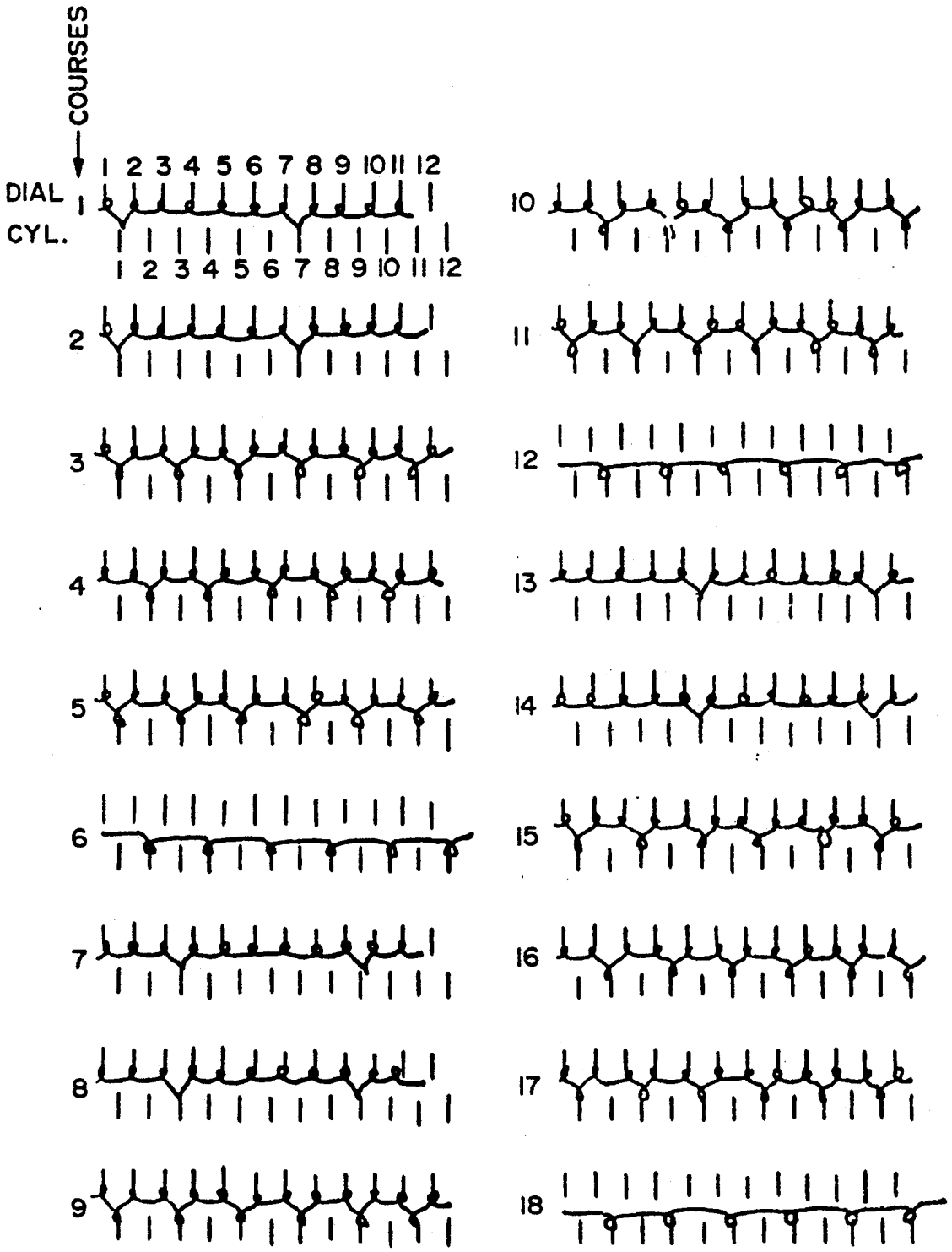
FIG. 1 is a schematic view, useful for explaining the double knit structure.
Figure 2:
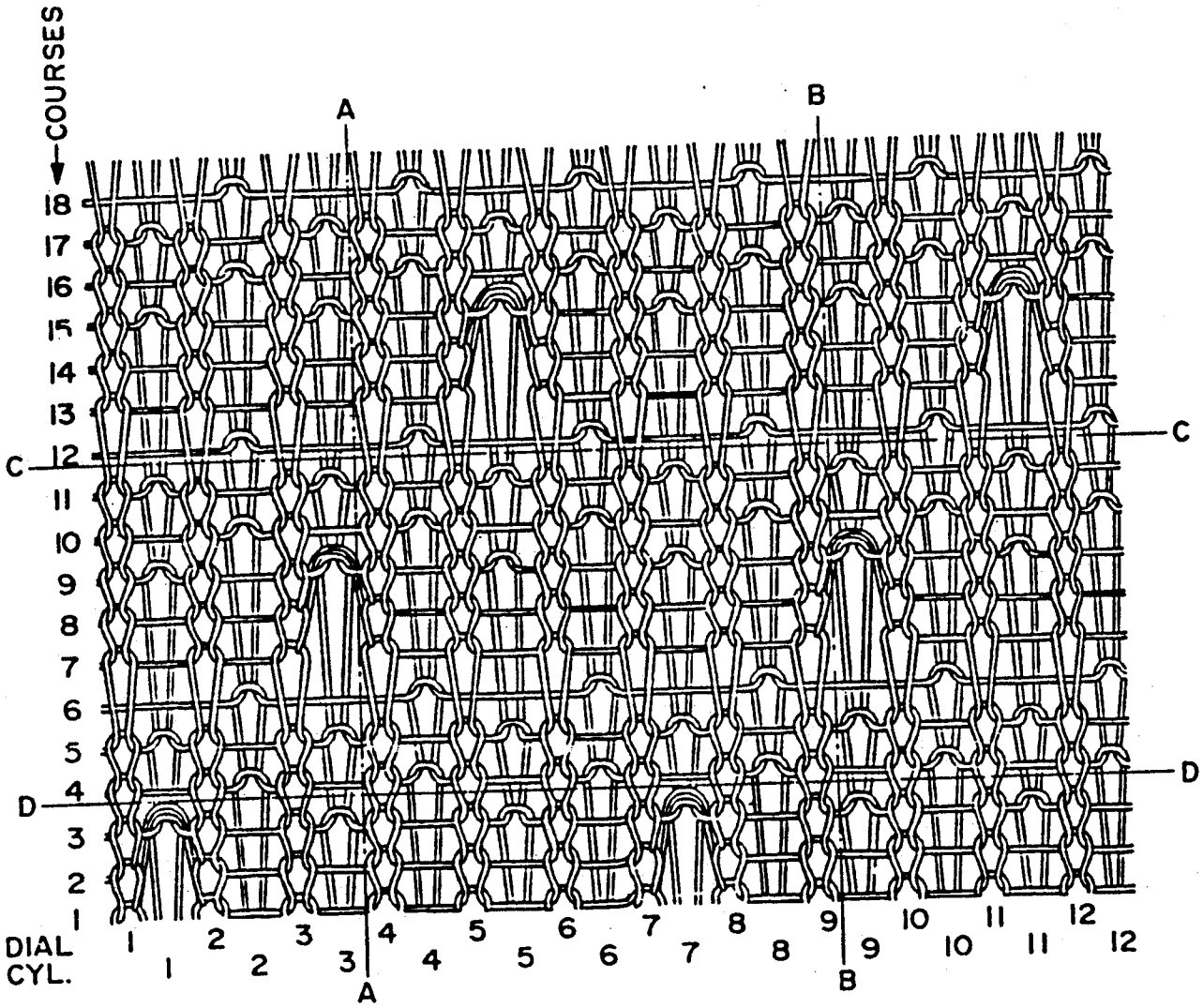
FIG. 2 is an enlarged view of the double knit structure.
Figure 3:
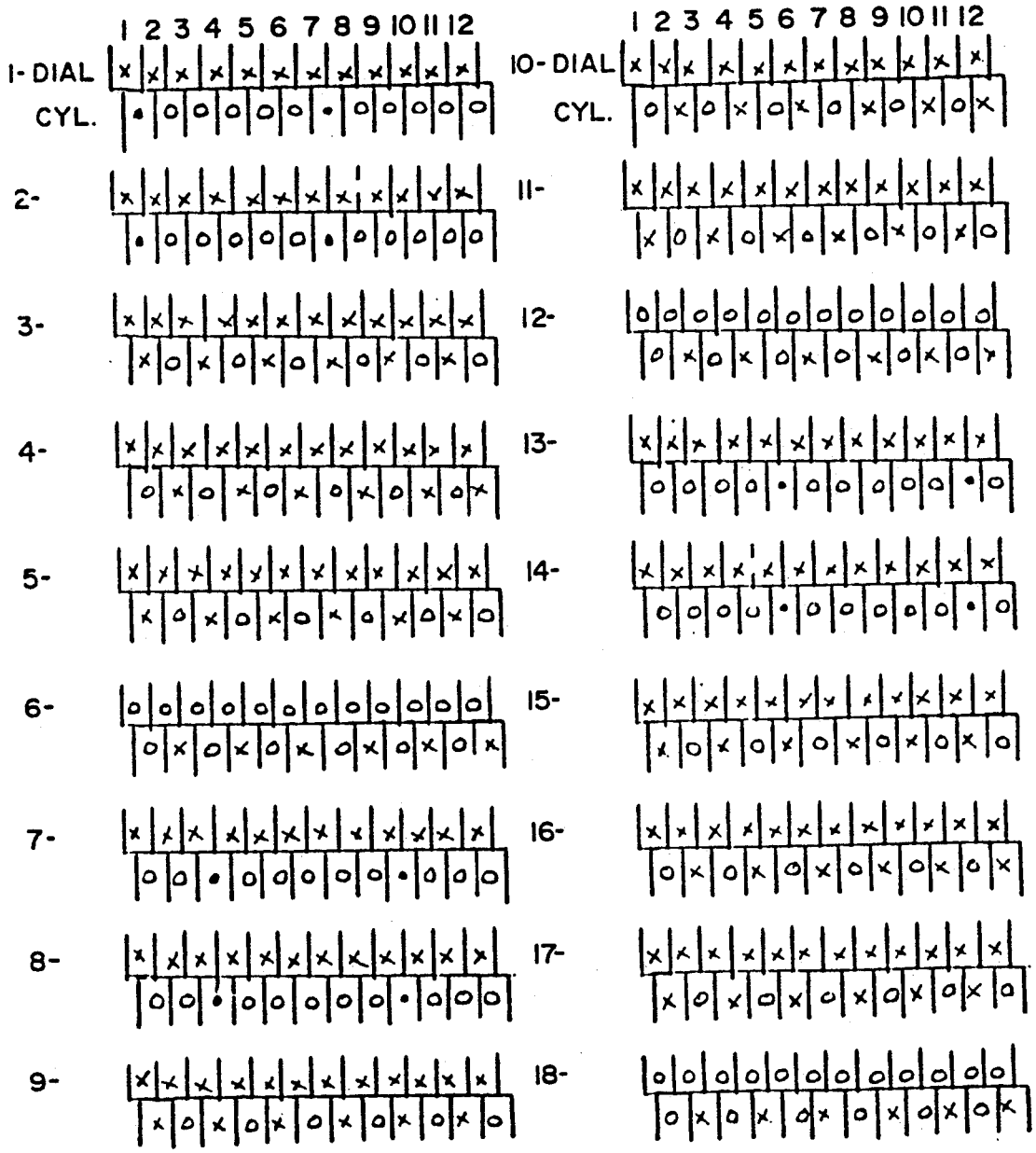
FIG. 3 is a different type of schematic view of the double knit structure.

FIG. 1, 2 and 3 are all different representations of the preferred embodiment of the present invention. They all represent a unitary pattern of eighteen courses and two adjacent sets of six cylinder wales with intermediary dial wales. Each course illustrated in FIG. 1, 2 and 3 has twelve needles on the dial and the cylinder respectively. One can readily observe and more particularly in FIG. 2 that the left hand side of the FIG. 2, being cylinder wales 1 to 6 inclusive for the full eighteen courses, is a duplicate or repeat of the same eighteen courses for cylinder wales 7 to 12 inclusive.

From a further examination of FIG. 1, 2 and 3 and more particularly of FIG. 2, one can visualize that the hole construction of the preferred embodiment of the invention is all the same.

In order to give the diagonal linear effect or alignment of the holes in the double knit fabric of the invention more apparent in FIG. 2, the hole configurations of the three sets of courses 1 to 6, 7 to 12, 13 to 18 inclusive are offset to the right one in relation to the lower one, by two cylinder wales; in reference to FIG. 1, and comparing course 1 with course 7 wherein the two tuck stitches on the cylinder of course 1 are at 1 and 7 while in course 7, they are at 3 and 9, while in course 13, they are at 5 and 11 and similarly for the second consecutive course at 2, 8 and 14 in relation thereto. All dial stitches are knitted except for course 6, 12 and 18.

In this fashion the repeat pattern for the holes is of three consecutive groups of six courses each, while on the other side, it is of six cylinder wales each. It can be appreciated that these holes can be relocated in the fabric to give straight linear vertical and horizontal arrangement or a full diagonal effect or other geometrical desired arrangement.

The preferred embodiment of a single hole construction in accordance with the invention is explained with reference to courses 6 to 11 of FIG. 1, 2, 3 and 4.

Figure 4:
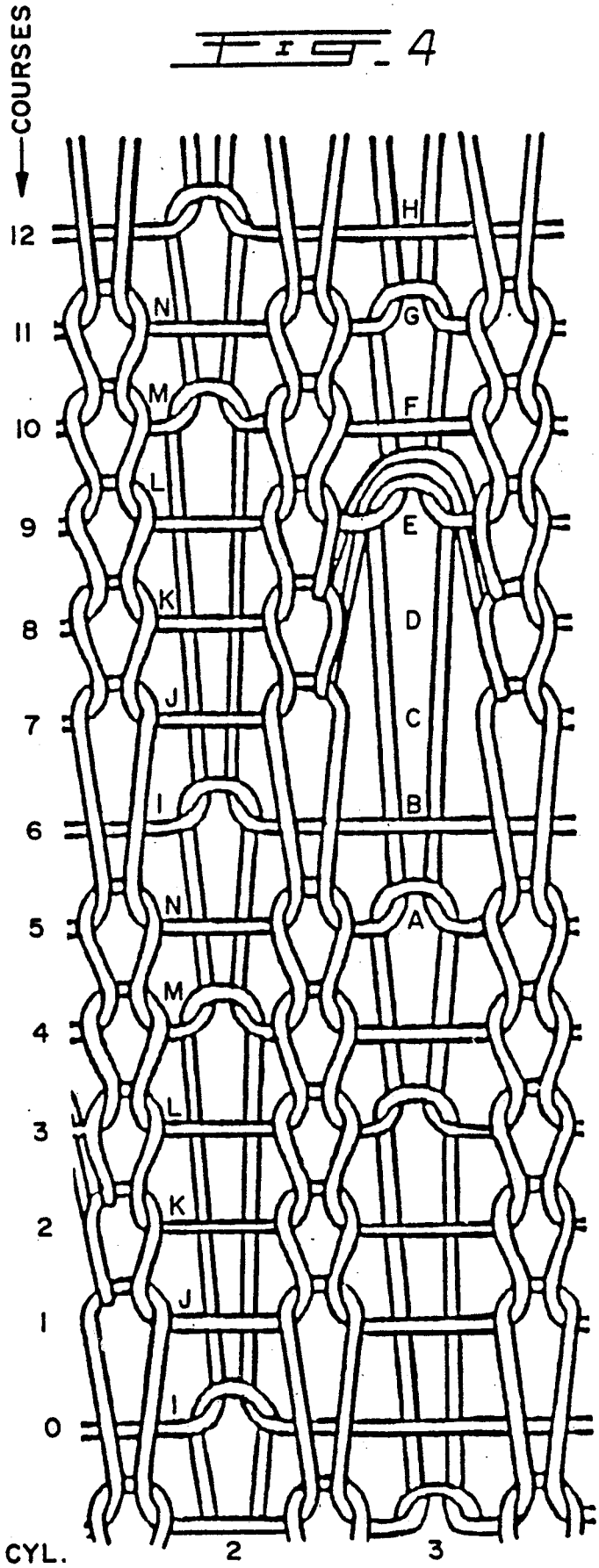
FIG. 4 is an isolated and enlarged view of a hole construction of the preferred embodiment useful to explain variations of the hole knitted construction.

Having reference to FIG. 4 which is a blown-up version of one hole from FIG. 2, one can readily observe that in the third wale, the course 5 is knitted at position E with yarn, instead of being knitted at position B with yarn 6 as it is for the adjacent wales 2 and 4. The sixth course above is not knitted at all in the third wale, therefore it is a welt knit. The two consecutive courses 7 and 8 are tuck stitches which are taken from positions C and D and knitted at position E with yarn 9. As a consequence, yarn 9 is holding course yarns 5, 7 and 8 altogether and, instead of being tied at the next course 10 or position F, it is knitted at position G with the yarn 11. This is providing greater tension on the three yarns 5, 7 and 8.

It can be appreciated that many modifications to the hole knitted construction can be made without departing from the invention. The hole may be made of only two consecutive tuck stitches, namely course 7 or 8 in reference to FIG. 2. Furthermore, one or two welt stitches can be associated to the said two tuck stitches and a further association of the former with one or more knit stitches can be made.

Figure 5:
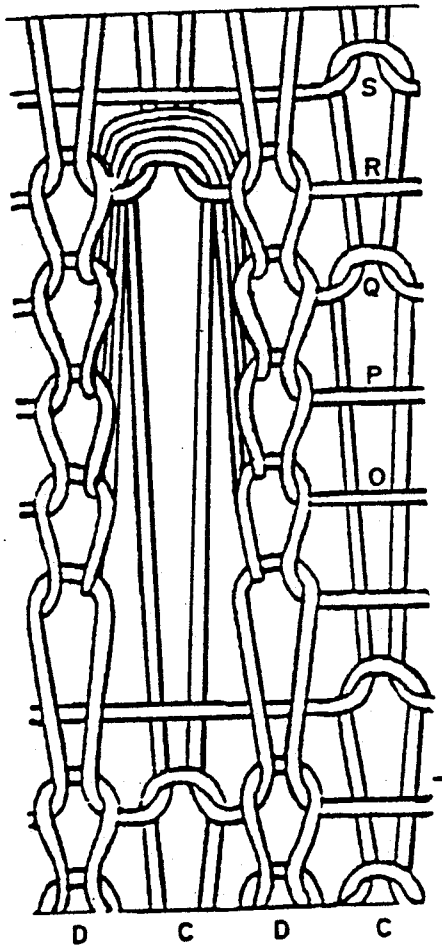
FIG. 5 is an enlarged and isolated view of an alternative longer hole construction of the double knit structure.

Another variation can take place with the use of only three tuck stitches, for courses 7, 8 and 9 instead of 7 and 8, but the hole would be longer. A more elongated vertical hole can be achieved if one combines four consecutive tuck stitches from courses 7, 8, 9 and 10 which could be tied still at position G with course 11 as illustrated in FIG. 5. In FIG. 5, two wales, over courses 6 through 12 include the following stitches, progressively from course 6 to course 12, in a first dial wale: welt, knit, knit, knit, knit, welt; in a first cylinder wale: welt, tuck, tuck, tuck, tuck, knit, welt; in a second dial wale: welt, knit, knit, knit, knit, welt; and a second cylinder wale: knit, welt, welt, welt, knit, welt, knit. A greater number of consecutive tuck stitches providing an even longer hole, can be made but additional modifications also have to be done. One may group four to six consecutive stitches but while using a finer yarn. It would even be possible to group together six to eight consecutive tuck stitches for a much longer hole but in having a coarser gage along with the said finer yarn aforementioned. Consequently to the increase in courses with tuck stitches, the number of courses in the repeat pattern will have to be adjusted accordingly. If we tuck three or four stitches together, a pattern of seven or eight courses may be desirable, similarly five, six, seven or eight tuck stitches would be better integrated in a pattern of respectively nine, ten, eleven or twelve courses. While the preferred embodiment uses two tuck stitches in a pattern of six courses, it is possible to achieve the invention in a pattern of as little as three, four or five courses, as long as there is one more course than the number of tuck stitches.

Another variation of the hole structure could be made with the courses 6, 12 and 18 and similarly for other holes, namely for the course that is at the bottom of the hole. These courses, as one can appreciate on FIG. 1, have this particularity that they are all welt stitches on the dial and also knit stitches on the cylinder at needles 2, 4, 6, 8, 10 and 12. This arrangement is to relieve the tension on the yarn or the course below the hole, so that the hole would not be pulled together or closed in, while this construction is in the preferred embodiment, but it may be done away with that with the understanding that the hole is then narrower. This is another variation within the invention. Another stitch may be used instead of a welt stitch as explained hereinafter.

In relation to the welt stitches 6, 12 and 18 at the bottom of the hole, such as for the hole in the third cylinder wale, the welt stitch in the sixth course, at location B can be modified and yarn 6 can be a knit stitch or tuck stitch tied with either yarn or course 9 at position E, 10 at position F or 11 at position G. The result would be that the fabric would not be as loose as it is in the preferred embodiment but the hole would still be there somewhat narrower than in the preferred embodiment. Corresponding modifications can be made with welt stitches 12 and 18.

Another variation in the knitting construction of the hole ca be made with the relocation of the course 9 in the third cylinder wale presently knit with the course 11 at position G in the preferred embodiment. Yarn 9 may be knitted with course 10 at position F while the welt stitch of course 10 could be a regular knit stitch with course 11 at position G or it could be knitted further up with yarn or course 12 at position H as it is for the adjacent cylinder wales 2 and 4.

Figure 6:
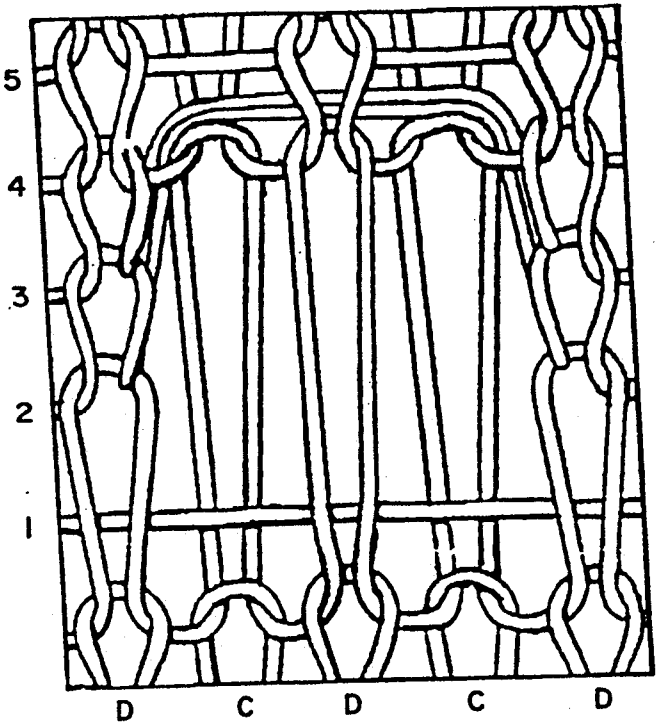
FIG. 6 is another enlarged isolated view of an alternative wider hole construction of the double knit structure.

In an alternative embodiment, it is possible to make an apparent larger hole through the fabric. In reference to FIG. 6, the knitting structure of such a hole includes a welt in a first course 1, followed by at least two consecutive tuck stitches in the following courses 2 and 3, a knit stitch in the following course 4, then a welt stitch in the course 5 and finally a knit stitch in the next course, not shown and this structure is repeated in the adjacent cylinder wale in a similar fashion and construction although it could be a different hole construction, while in the dial wale located in between the said cylinder wales, there will be a welt stitch on the said first course 1 corresponding to the welt stitch on the cylinder and then two consecutive welt stitches 2 and 3 thereafter. Because of the lighter density of the fabric, this will give a somewhat apparent or partial hole in the fabric resulting from the vertical yarns across the area. It can thus also assist in control of body heat as the other holes described herein before.

In reference to FIG. 2, the knitting structure between the various holes of the preferred embodiment, a given area is defined by the intercrossing of lines AA, BB vertically and CC, DD horizontally. We have conceived it to provide a fabric with the desired weight and elasticity, but the combination of knit, tuck and welt stitches on the cylinder and dial can be modified without departing from the invention.

Figure 7:
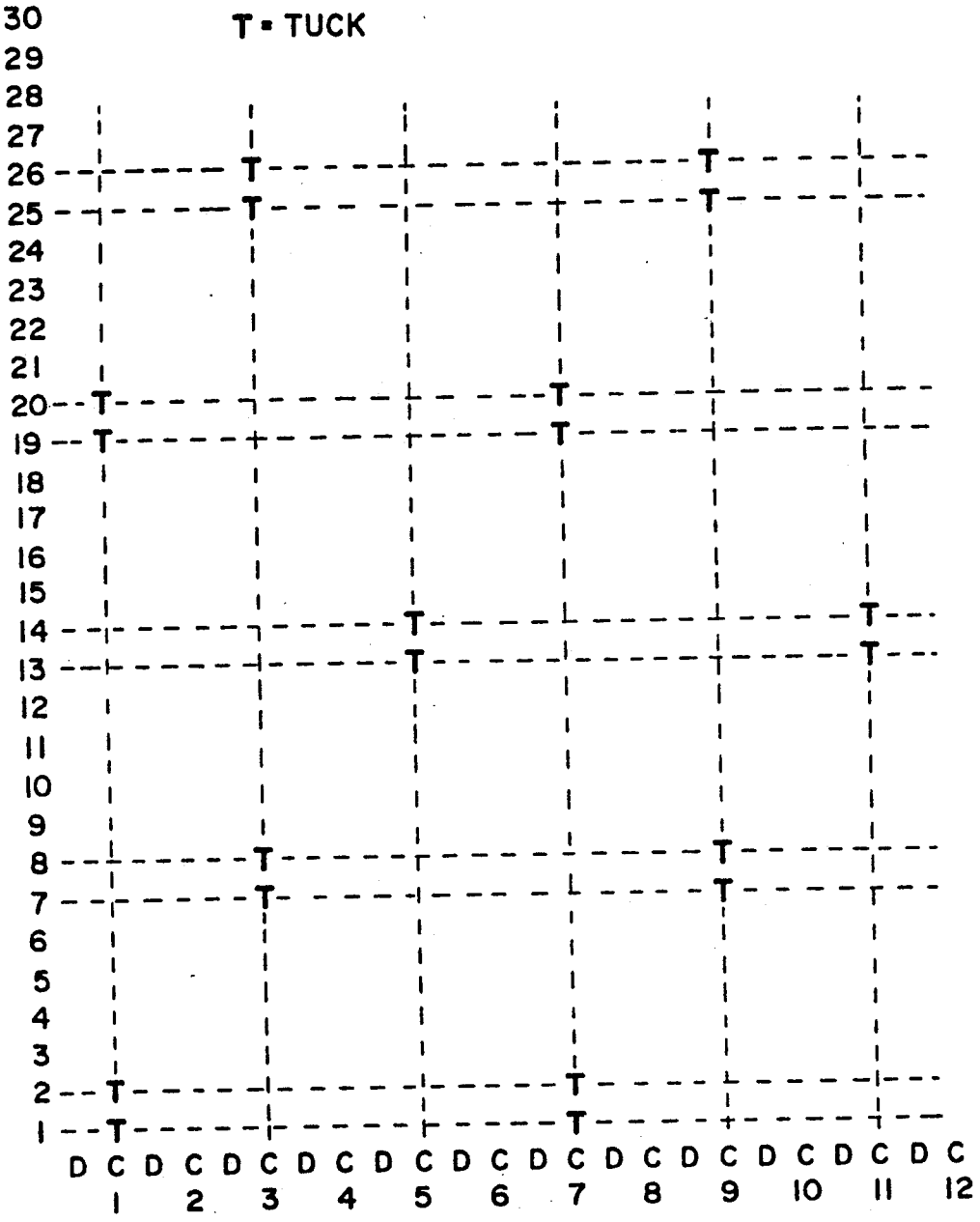
FIG. 7 is a grid schematic representation of the holes assembly in the preferred embodiment.
Figure 8:
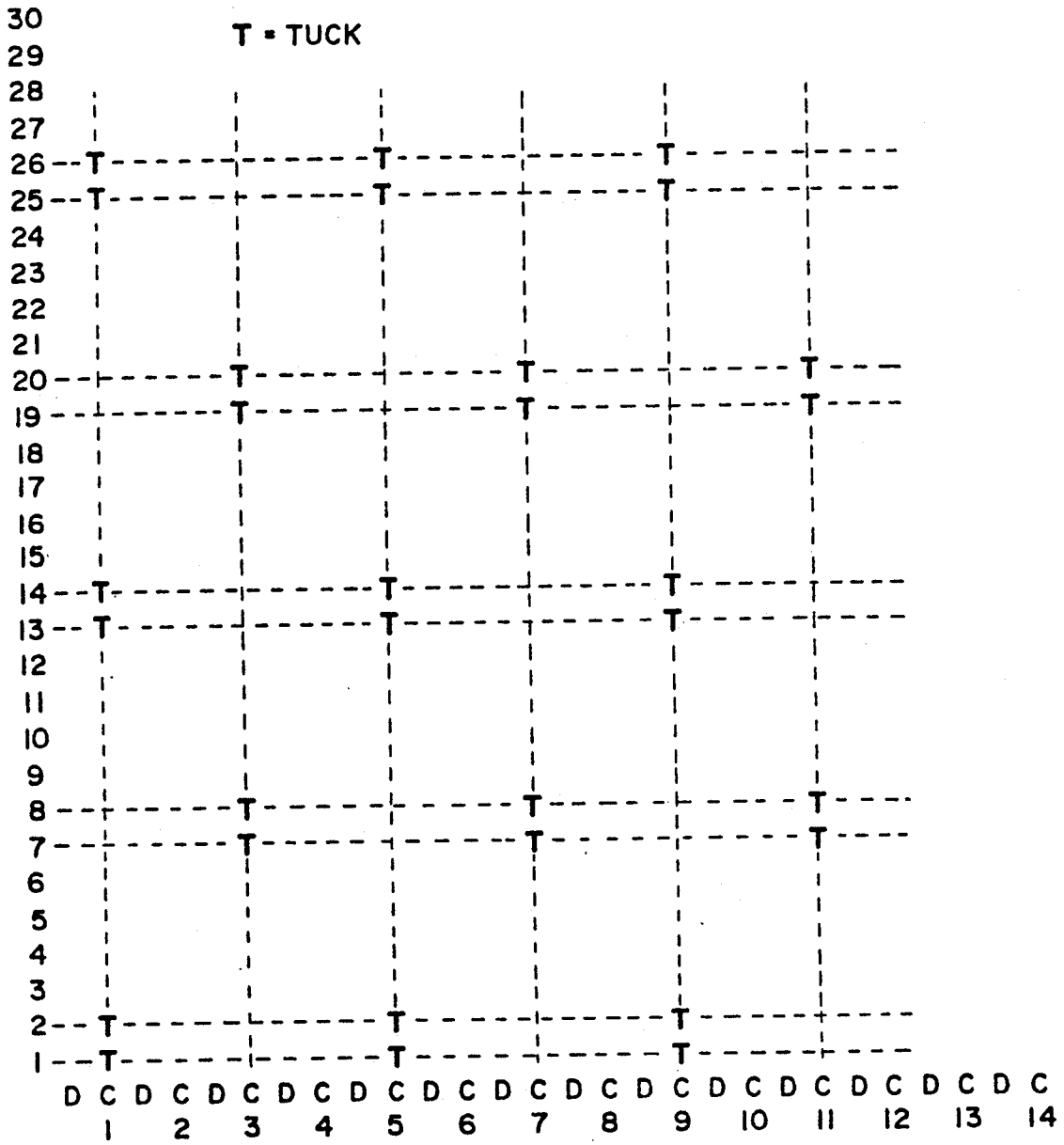
FIG. 8 is a grid schematic representation of alternative hole assemblies.
Figure 9:
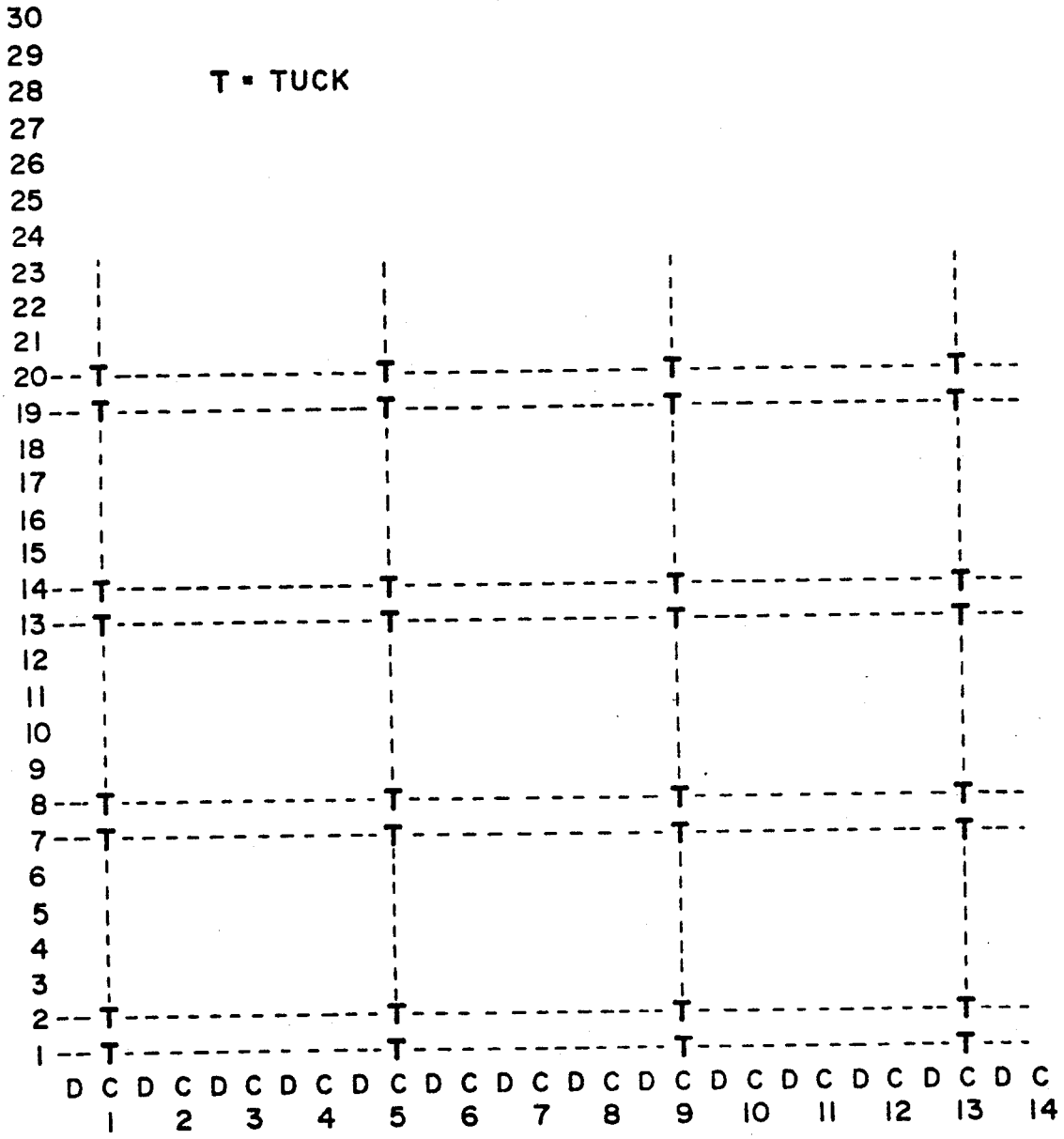
FIG. 9 is another grid schematic representation of alternative hole assemblies.

In the preferred embodiment, the alignment of the holes is to make diagonal lines with a repeat at every three groups of six courses and every group of six cylinder wales as illustrated in FIG. 2 and 7. The holes can be knitted closer together, therefore instead of having a hole in wales 1 and 7 for the first course, 3 and 9 for the second course, 5 and 11 for the third set of courses, they may be much closer such as 1 and 3, 3 and 5, 5 and 7 on a horizontal plan, as well as one above the others all in the same wale or with an alternance that could be achieved if the hole in wale 5 made by courses 13 and 14 would be made in wale 1 instead the pattern in this latter instance would be repeated every three wales and twelve courses. The distance between the holes not only can be closer but it can be greater, more than six wales as well as less or more than six courses for a repeat. The net result would simply be in having a greater or lesser number of holes and disposition thereof in the fabric. The combination of the number of holes and the type of knitting as between the hole will determine the density, weight and elasticity of the fabric. Certain hole arrangements are illustrated, such as the preferred embodiment in FIG. 7 and two of many possibilities in FIG. 8 and 9.

Horizontal color bands of various colors and widths can be knitted in the fabric at any stage in changing the color of a selected consecutive number of courses taking into account the size of the yarn, the knitting structure and density to determine the width of the color arrangement that is desirable.

In the color band delineation, if one wishes to avoid visual indentation that may be made by extended yarns in the area where holes are made, the change of yarn can be effected at courses 4 or 5, 10 or 11, 16 or 17 in the preferred embodiment.

The man skilled in the art will appreciate that in using the invention making the double-knit fabric and carrying the process hereinafter described, one may use different yarns, made of synthetic or natural fiber and of different sizes be it one hundred deniers, larger or smaller depending on the fabric density and the number of tuck stitches to be grouped together.

Reasonable variations and modifications are possible within the scope of foregoing disclosure, the drawings and the appended claims to the inventions.

What is claimed is:

1. A fabric of double knit construction for use in a sports garment to allow control of body heat with respect to perspiration of the player wearing same, said fabric comprising:

a repeating pattern of at least eight courses and two cylinder wales, a first cylinder wale of said two cylinder wales including consecutive courses, in sequence, having a knit stitch, a welt stitch, four tuck stitches, a knit stitch and welt stitch to form a hole, said pattern being repeated to form the fabric with a plurality of holes.

2. The knit construction of claim 1, wherein said consecutive courses include in a first dial wale, a knit stitch, a welt stitch, five knit stitches and a welt stitch.

3. The knit construction of claim 2, wherein said consecutive courses include in a second dial wale, a knit stitch, a welt stitch, five knit stitches and a welt stitch.

* * * * *